US006199352B1

(12) United States Patent
Beaston

(10) Patent No.: US 6,199,352 B1
(45) Date of Patent: Mar. 13, 2001

(54) HORSE RESTRAINER

(76) Inventor: Bud Beaston, Rte. 2, Box 88, Sperry, OK (US) 74073

( * ) Notice: Subject to any disclaimer, the term of this patent is extended or adjusted under 35 U.S.C. 154(b) by 0 days.

(21) Appl. No.: 09/345,140

(22) Filed: Jul. 6, 1999

(51) Int. Cl.[7] ..... B68B 1/02
(52) U.S. Cl. ..... 54/24
(58) Field of Search ..... 54/6.1, 6.2, 24

(56) References Cited

U.S. PATENT DOCUMENTS

| | | | | |
|---|---|---|---|---|
| 398,087 | | 2/1889 | Schwaner . | |
| 1,093,486 | * | 4/1914 | Scott | 54/24 |
| 1,370,618 | | 3/1921 | Turner | 54/24 |
| 1,552,145 | | 9/1925 | Haile . | |
| 2,526,140 | | 10/1950 | Keyston | 54/24 |
| 2,752,746 | * | 7/1956 | Swartz | 54/6.1 |
| 2,961,816 | * | 11/1960 | Reed | 54/24 |
| 3,149,448 | | 9/1964 | Smith | 54/6.1 |
| 3,306,005 | | 2/1967 | Stafford | 54/6 |
| 3,458,971 | | 8/1969 | Stern et al. | 54/6.1 |
| 3,657,863 | * | 4/1972 | Blair | 54/6.1 |
| 4,094,131 | | 6/1978 | McElvey | 54/24 |
| 4,337,610 | | 7/1982 | Taylor | 54/24 |
| 4,583,493 | | 4/1986 | Terry | 119/130 |
| 4,589,248 | | 5/1986 | Ruddock et al. | 54/24 |
| 4,774,801 | | 10/1988 | Johansen et al. | 54/34 |
| 5,001,892 | | 3/1991 | Mezin et al. | 54/71 |
| 5,660,031 | | 8/1997 | Clark | 54/71 |

* cited by examiner

*Primary Examiner*—Robert P. Swiatek
(74) *Attorney, Agent, or Firm*—Head, Johnson & Kachigian

(57) ABSTRACT

A restrainer for mounting on the head of a horse is in the form of a generally oval shaped rigid, toroidal like member dimensioned and configured to slidably fit over the facial crest of the nose, under the lower jaw and intermediate the nose tip and eyes of a horse. Attachments are affixed to opposite sides of the rigid member and straps affixed to the attachments extend behind the head of the horse to retain the member on the horse's nose.

16 Claims, 2 Drawing Sheets

HORSE RESTRAINER

REFERENCE TO PENDING APPLICATIONS

This application is not related to any pending United States or international patent application.

REFERENCE TO MICROFICHE APPENDIX

This application is not referenced in any Microfiche Appendix.

BACKGROUND OF THE INVENTION

This invention relates to a device in the general nature of a bridle or halter as used on a horse for purposes of restraining a horse and is particularly useful in breaking an untamed horse so that it can be more easily cared for, ridden or worked.

Bridles and halters have been used on horses since this majestic animal was first subdued by mankind. Commonly available materials have historically been employed for bridles or halters, the most commonly used material being leather although components of bridles and halters have been made of woven fibers, such as woven wool or cotton straps. Metal has been employed for bits that are positioned within the mouth of the horse or for loops, rings or buckles that facilitate attaching one component to another.

For background information relating to examples of use of bridles, halters, harnesses and other components, to aid in controlling, training, leading and/or riding a horse reference may be had to the following prior issued United States patents:

| U.S. PAT. NO. | INVENTOR | TITLE |
|---|---|---|
| 398,087 | Schwaner | Halter Square |
| 1,370,618 | Turner | Jaw Cinch |
| 1,552,145 | Haile | Breaking Bridle |
| 2,526,140 | Keyston | Harness and Ring Therefor |
| 3,149,448 | Smith | Hackamore Bridle |
| 3,306,005 | Stafford | Hackamore Bridle |
| 3,458,971 | Stern et al. | Horse Training Device |
| 4,094,131 | McElvey | Animal Halter |
| 4,337,610 | Taylor | Animal Control Halter |
| 4,583,493 | Terry | Animal Training Device |
| 4,589,248 | Ruddock, administrator et al. | Horse Training Halter |
| 4,774,801 | Johansen et al. | Horse Halter with Attached Lead Lines |
| 5,001,892 | Mezin et al. | Equine Equipment |
| 5,660,031 | Clark | Method and Apparatus for Training Horses |

BRIEF SUMMARY OF THE INVENTION

The invention is a restrainer for mounting on the head of a horse. By "restrainer" is meant a device to help subdue and traumatize a horse to make the horse more amenable to instruction and training and therefore easier to handle, ride or work. The restrainer that is the subject of this invention is intended to help control a horse without imparting any pain or significant discomfort to the horse and without risk of injury to the horse with which it is used. The invention is in the form of a generally oval shaped rigid toroidal like member dimensioned and configured to slideably fit over the facial crest of the nose, under the lower jaw and intermediate the nose tip and eyes of a horse. The member of the preferred embodiment is made of metal and is particularly adaptable to be made of a metal rod of about ½ inch in diameter, the rod being bent into the form of an oval with substantially parallel opposed sides and with an integral upper semi-circular portion that fits over the facial crest of the horse and a lower, integral, semi-circular portion that fits under the lower jaw. To practice the invention the member must be solid, that is not readily deformable and must be sufficiently rigid that it will not be bent out of its intended shape when in use on a horse. The member is preferably made of steel.

Attachments are affixed to opposite sides of the rigid member. In the preferred embodiment the attachments are in the form of metal rings. In the most preferred embodiment two metal rings are welded to each of the opposed sides of the member. The metal rings are preferably oval shaped.

Affixed to the attachments are straps that extend to loop over the neck and behind the head of a horse to retain the member on the horse's facial crest. The straps are preferably in the form of two separate portions. The first portion of each strap is a cheek piece in the form of a forward Y-shaped portion affixed to the attachments on the rigid member. The distal extending portion of each strap is provided with means so that they can be secured to each other and preferably in an adjustable manner so that the restrainer can be secured in place to comfortably but securely position the oval shaped rigid toroidal like member on the facial crest of a horse and to facilitate removal of the restrainer.

A better understanding of the invention will be obtained from the following detailed description of the preferred embodiment taken in conjunction with the attached drawing.

DETAILED DESCRIPTION OF A PREFERRED EMBODIMENT

Figure 1:
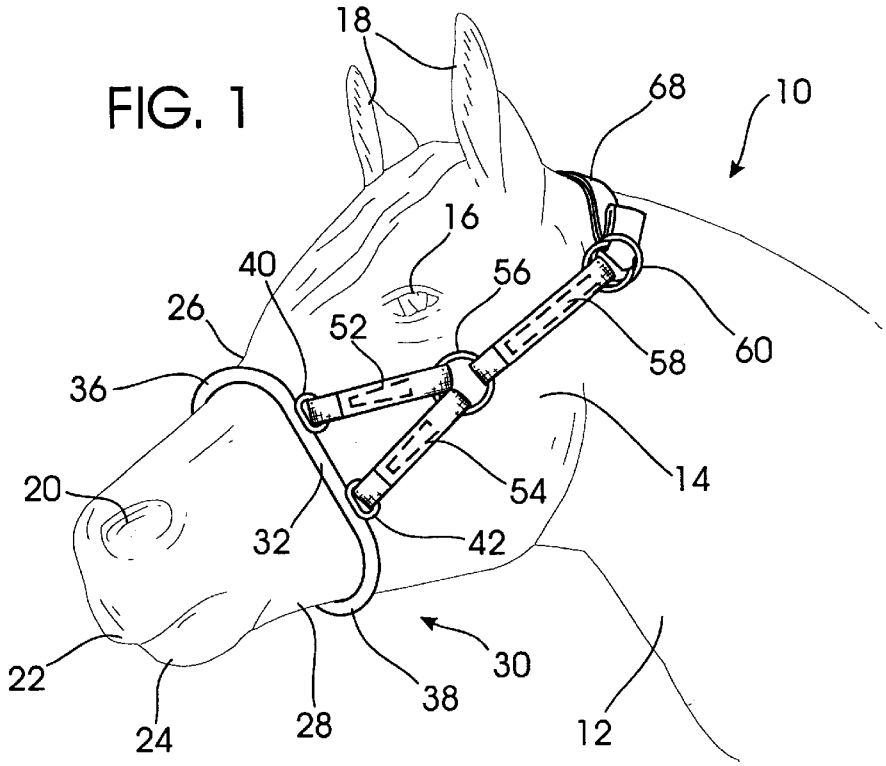
FIG. 1 is an isometric view showing the restrainer of this invention mounted on the head of a horse.
Figure 2:
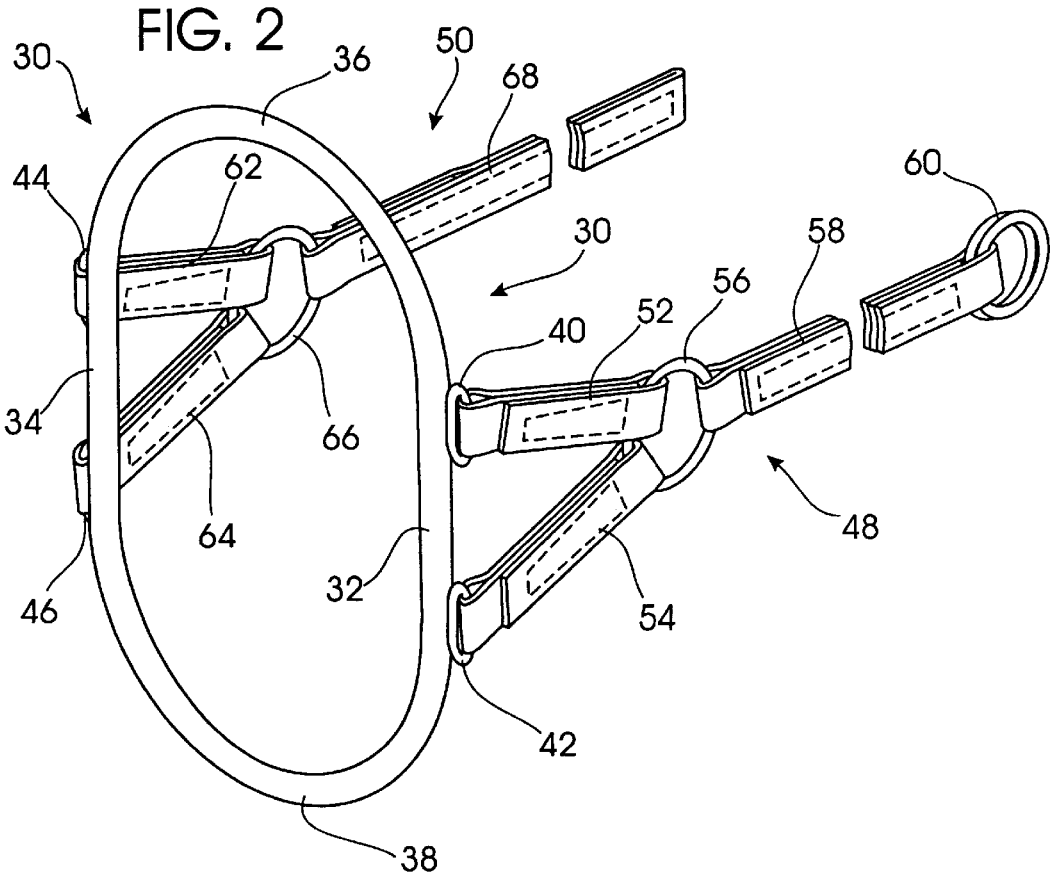
FIG. 2 is an enlarged elevational isometric view of the restrainer.
Figure 3:
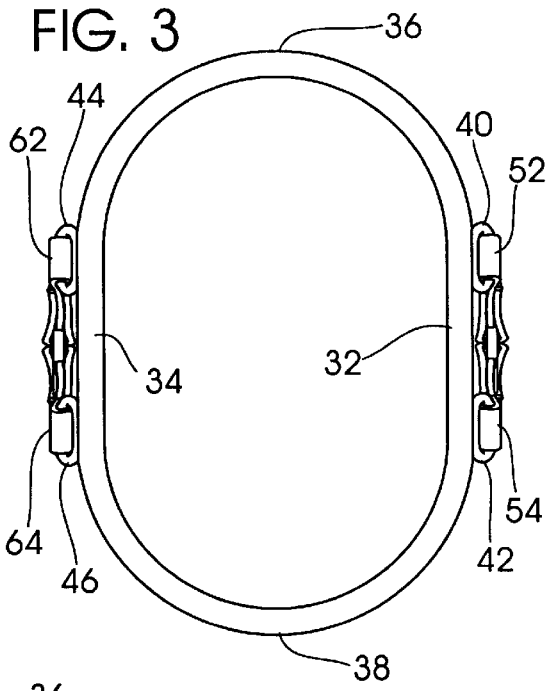
FIG. 3 is a front elevational view of the restrainer.
Figure 6:
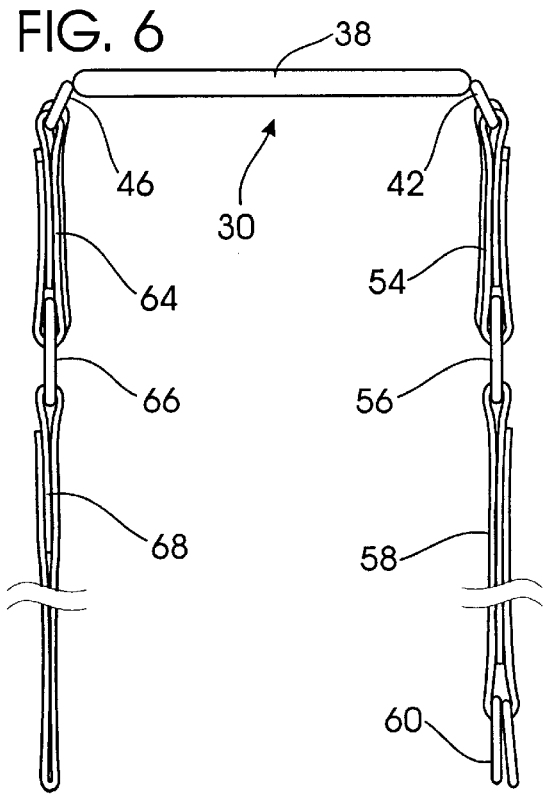
FIG. 6 is a top plan view of the restrainer as shown in FIGS. 1–5.
Figure 4:
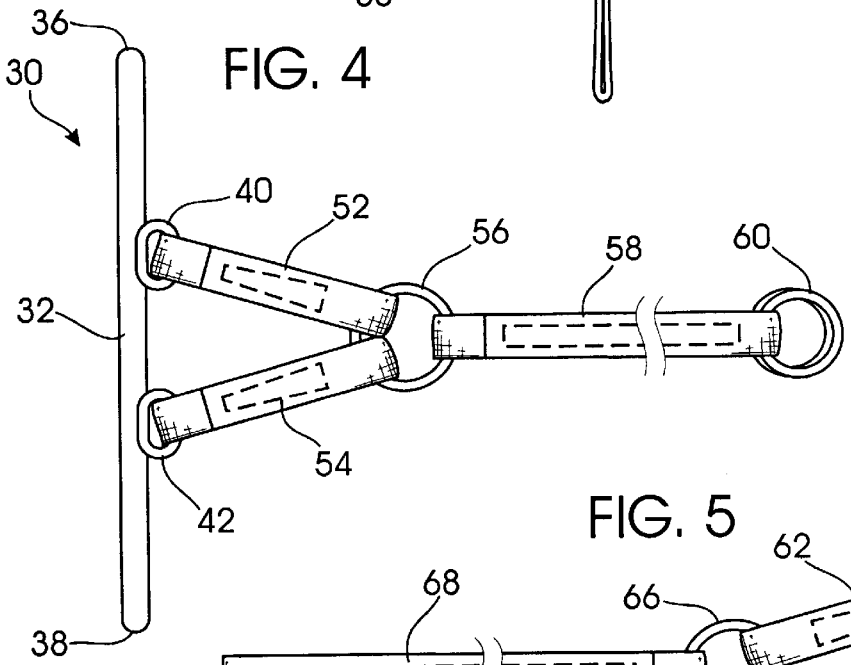
FIG. 4 is an elevational view of one side of the restrainer showing more details of the straps used to secure the restrainer on a horse.
Figure 5:
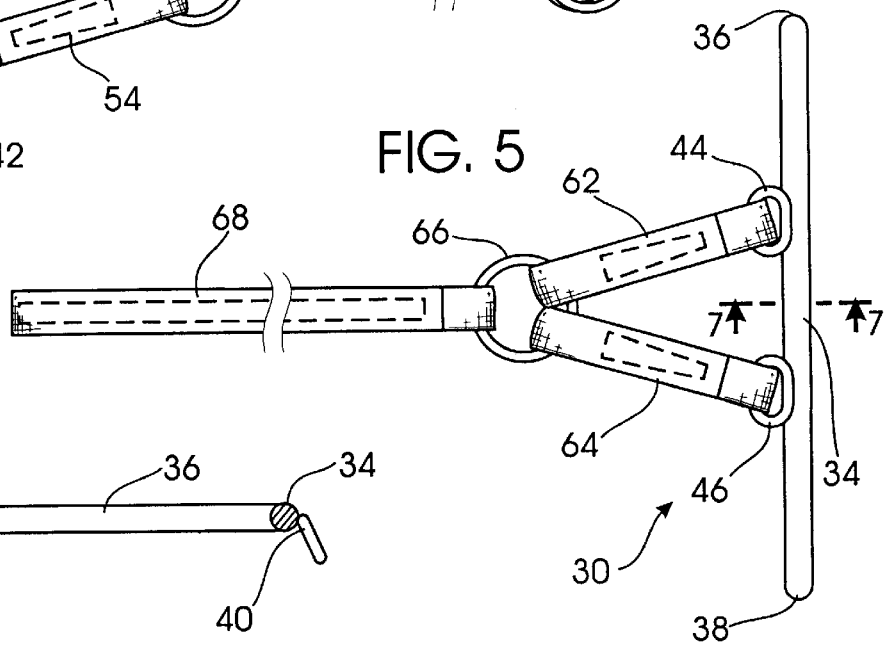
FIG. 5 is an elevational view of the opposite side of the restrainer.
Figure 7:
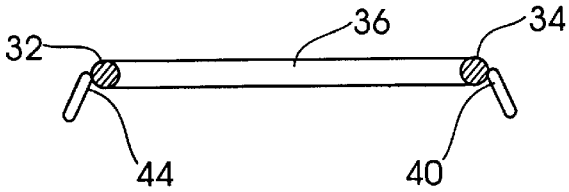
FIG. 7 is a fragmentary cross-sectional view taken along the line 7—7 of FIG. 5.

Referring to the drawings with first to FIG. 1 the restrainer of this invention is shown mounted on the head of a horse. The horse is generally indicated by the numeral 10, the horse's neck by the numeral 12 and the head of the horse by the numeral 14. The drawing clearly shows the horse's left eye 16, ears 18, left nostril 20, upper lip 22, lower lip 24, facial crest 26 and lower jaw 28. Mounted on the head 14 of horse 10 is the restrainer that is, as seen in FIGS. 2–7, a generally oval shaped rigid toroidal like member generally indicated by the numeral 30. The rigid member 30 is formed of an endless loop of solid material such as metal, steel being a preferred material. The oval shape provides opposed parallel side portions 32 and 34 which are straight or substantially straight with integrally included top semi-circular portion 36 and bottom semi-circular portion 38. Member 30 is preferably oval, as previously stated and can be manufactured by bending an elongated cylindrical rod into the prescribed shape and welding the ends together to perform an endless loop. The rod of which the member 30 is formed should be about ½ inch in diameter. The member 30 is preferably made of steel or of other metal or of a stiff plastic however, experience has indicated that if the member is made of metal it achieves more effective results due to the additional weight obtained by the use of metal.

Affixed to member 30 are attachments. In the illustrated and preferred embodiment the attachments are in the form of two sets of rings. Affixed to the member left side portion 32 is an upper ring 40 and lower ring 42. In like manner affixed to the member right side portion 34 is an upper ring 44 and a lower ring 46. Each of the rings 40, 42, 44 and 46 is preferably oval in shape as illustrated and preferably of metal and are preferably attached to member 30 by welding.

Secured to attachments 40 and 42 is a first or left side cheek piece strap generally indicated by the numeral 48 and in like manner affixed to the right side of member 30 is a second or right side cheek strap 50. The left cheek strap 48 includes a forward Y-shaped portion formed by short straps 52 and 54. Forward portions of straps 52 and 54 are secured to rings 40 and 42 respectively and the rearward ends of straps 52 and 54 are secured to a cheek ring 56. Extending from cheek ring 56 is a strap distal portion 58 that terminates at its distal end with a buckle 60. In the illustrated arrangement buckle 60 is in the form of two rings. In like manner the second or right side cheek strap 50 includes short straps 62 and 64 that are secured to rings 44 and 46 at their forward ends and at their rearward ends to cheek ring 66. Extending from cheek ring 66 is strap distal portion 68.

The method of use of the restrainer will now be described. The restrainer is easily secured to the head of the horse by slipping the restrainer member 30 over the nose of the horse. The member is configured and diminsioned to slide easily on the horse so that the member top semi-circular portion 36 rests on the horse's facial crest 26 and the bottom semi-circular portion 38 is an engagement with or in close proximity to the horse's lower jaw 28. Member 30 is positioned approximately midway between the horse's upper lip 22 and eyes, only left eye 16 being seen in FIG. 1. Distal straps 58 and 68 are buckled together in a loop that extends over the top of the horse's neck 12 and behind the horse's ears 18 so that the restrainer is held in place on the horse. While not shown, a chin strap, commonly used on bridles and halters could be employed, however it is not deemed necessary or indispensable.

Member 30 is configured so that it fits on the face of a horse intermediate the horse's lips and eyes in a way that is comfortable and such that it imposes no pain to the horse. Other than preventing the horse from widely opening his or her mouth, the restrainer does not impose any limitation on the horse.

The purpose of the restrainer is to create, without the use of pain or significant physical impairment, an unnatural environment for the horse. That is, the hard, preferably metal member 30 creates a new, different and unnatural environment for the horse. The horse is thereby psychologically subdued. Impairment caused by the restrainer to a horse is more mental than physical. The only physical restriction caused by the restrainer is the ability of the horse to open his or her mouth, but the horse is not otherwise limited in movement in any way, nor is the horse subject to any pain. Stated another way, any discomfort caused by the restrainer is mental or emotional and only minimally physical. This mental or emotional burden makes a horse, with the restrainer in place, more subdued and tractable and therefore more readily trainable. Thus the restrainer is particularly useful in breaking a horse to ride, to follow, to work or for other purposes.

The restrainer as disclosed herein is not intended essentially as a substitute for a bridle or halter. That is, its primary function is not to provide a way to control the direction of a horse being ridden or to particularly provide a means for guiding a horse being lead and thus the restrainer is not a substitute for known bridles and halters of the prior art. The uniqueness of the invention herein is the use of a stiff solid and somewhat heavy oval shaped rigid toroidal like member 30 configured to fit on the nose of a horse of dimension and weight to impose mental or psychological changes in the attitude of the horse on which it is used rather, as with prior devices to provide a means for guiding or controlling a horse.

The member 30 is termed "toroidal like" only to mean that it is an endless physical object preferably cylindrical in cross-sections although from the front or rear view it is not circular but it is oval in shape.

While the invention has been described with a certain degree of particularity, it is manifest that many changes may be made in the details of construction and the arrangement of components without departing from the spirit and scope of this disclosure. It is understood that the invention is not limited to the embodiments set forth herein for I purposes of exemplification, but is to be limited only by the scope of the attached claim or claims, including the full range of equivalency to which each element thereof is entitled.

What is claimed:

1. A restrainer for mounting on the head of a horse comprising:

a generally oval shaped rigid, toroidal-like, monolithic one-piece, solid, unitary member dimensioned and configured to slidably fit over and surround the facial crest of the nose and the lower jaw of a horse and intermediate the nose tip and eyes of the horse;

attachments affixed to opposite sides of said rigid unitary member; and straps affixed to said attachments extend to loop behind the head of a horse to retain said member.

2. A restrainer for mounting on the head of the horse according to claim 1 in which said unitary member is formed of metal.

3. A restrainer for mounting on the head of a horse according to claim 2 wherein said unitary member is made of steel.

4. A restrainer for mounting on the head of a horse according to claim 2 wherein said attachments are made of metal and welded to said member.

5. A restrainer for mounting on the head of the horse according to claim 1 in which said unitary member is substantially circular in cross-section.

6. A restrainer for mounting on the head of a horse according to claim 1 in which said unitary member has opposed, paralleled substantially straight side portions and integral semi-circular top and bottom portions.

7. A restrainer for mounting on the head of a horse according to claim 1 wherein said attachments include a first pair of spaced apart attachments on a first side of said unitary member and a second pair of spaced apart attachments on a second side of said unitary member.

8. A restrainer for mounting on the head of a horse according to claim 7 wherein said straps include a first cheek piece strap having a forward Y-shaped portion affixed to said first pair of attachments and a second cheek piece strap having a forward Y-shaped portion affixed to said second pair of attachments, said straps having distal end portions and a connector for releasably interconnecting said distal portions of said first and second straps.

9. A restrainer for mounting on the head of a horse according to claim 1 wherein said unitary member is made of metal and is circular in cross-section of about ½ inch diameter.

10. A restrainer for mounting on the head of a horse comprising:

a generally oval shaped rigid, toroidal-like member dimensioned and configured to slidably fit over the facial crest of the nose, under the lower jaw and intermediate the nose tip and eyes of a horse;

a first pair of spaced apart attachments on a first side of said member and a second pair of spaced apart attachments on a second side of said member; and straps affixed to said attachments extending to loop behind the head of a horse to retain said member, the straps including a first cheek piece strap having a forward Y-shaped portion affixed to said first pair of attachments and a second cheek piece strap having a forward Y-shaped portion affixed to said second pair of attachments, said cheek piece straps having distal end portions, that are releasably interconnected.

11. A restrainer for mounting on the head of the horse according to claim 10 in which said member is formed of metal.

12. A restrainer for mounting on the head of a horse according to claim 11 wherein said member is made of steel.

13. A restrainer for mounting on the head of a horse according to claim 11 wherein said attachments are made of metal and welded to said member.

14. A restrainer for mounting on the head of a horse according to claim 11 wherein said member is circular in cross-section of about ½ inch diameter.

15. A restrainer for mounting on the head of the horse according to claim 10 in which said member is circular in cross-section.

16. A restrainer for mounting on the head of a horse according to claim 10 in which said member has opposed, paralleled substantially straight side portions and integral semi-circular top and bottom portions.

* * * * *